US006006928A

United States Patent [19]

Parker

[11] Patent Number: 6,006,928

[45] Date of Patent: Dec. 28, 1999

[54] DEVICE FOR STORING ELONGATED OBJECTS

[75] Inventor: Kenneth D. Parker, Phoenix, Ariz.

[73] Assignee: U-Haul International Inc., Phoenix, Ariz.

[21] Appl. No.: 09/185,415

[22] Filed: Nov. 3, 1998

[51] Int. Cl.[6] ..... A47F 5/00

[52] U.S. Cl. ..... 211/60.1; 211/70.6; 211/94.01

[58] Field of Search ..... 211/60.1, 70.6, 211/94.01, 162, 74, 106

[56] References Cited

U.S. PATENT DOCUMENTS

| | | | |
|---|---|---|---|
| 1,743,570 | 1/1930 | Russian | 211/70.6 X |
| 2,327,379 | 8/1943 | Thomas | 211/74 |
| 2,370,455 | 2/1945 | Eng | 211/94.01 X |
| 2,703,253 | 3/1955 | Biederman | 211/74 X |
| 2,917,181 | 12/1959 | Staub | 211/60 |
| 3,890,197 | 6/1975 | Butts et al. | 176/78 |
| 4,154,442 | 5/1979 | Trubody et al. | 211/85.7 X |
| 4,315,633 | 2/1982 | Boeddeker et al. | 280/79.3 |
| 5,209,358 | 5/1993 | Simard | 211/94.01 X |
| 5,209,359 | 5/1993 | Arnold | 211/106 |
| 5,785,189 | 7/1998 | Gollob et al. | 211/106 X |

*Primary Examiner*—Robert W. Gibson, Jr.
*Attorney, Agent, or Firm*—Jeffer, Mangels, Butler & Marmaro LLP

[57] ABSTRACT

A device for storing objects includes a mounting member and a rack assembly affixed to the mounting member. The rack assembly includes first and second mounting bars in spaced relation and at least one connection member holding the first and second mounting bars in spaced relation.

23 Claims, 6 Drawing Sheets

DEVICE FOR STORING ELONGATED OBJECTS

FIELD OF THE INVENTION

The present invention relates to a device for storing objects, and more particularly to a device having spaced mounting bars for storing elongated objects.

BACKGROUND OF THE INVENTION

When not in use, elongated rods such as those used for hanging clothing and the like are often difficult to store. For example, moving companies sell wardrobe boxes that are designed to transport clothing. The box comes with an elongated crossbar that spans across the box interior allowing hangered clothing to be hung just the same as in a closet. When not in use these crossbars must be stored in a place where they can be seen by a consumer, but do not take up a great deal of room. Due to their awkward size and length, when these crossbars are placed on the floor they tend to take up a large amount of floor space. When leaned against a wall or in a corner they often slide and/or fall over. Floor racks have been designed for containing rods or the like. However, the rack itself typically requires a large amount of floor space in the retailers showroom.

A need exists for a rack that holds elongated rods, crossbars and the like above a floor, yet does not take up a large amount of floor space.

SUMMARY OF THE PREFERRED EMBODIMENTS

In accordance with one aspect of the present invention, there is provided a device for storing objects that includes a mounting member and a rack assembly affixed to the mounting member. The rack assembly includes first and second mounting bars in spaced relation and at least one connection member holding the first and second mounting bars in spaced relation.

In a preferred embodiment, the first and second mounting bars define a mounting plane and the connection member(s) include first and second ends and a middle portion. The first and second ends of the connection member(s) are affixed to the first and second mounting bars, respectively, and the middle portion extends above the mounting plane.

In another preferred embodiment, the first and second mounting bars are in parallel spaced relation.

In accordance with another aspect of the present invention, there is provided a device for storing objects that includes an elongated mounting member, and a rack assembly affixed to said mounting member. The rack assembly includes first and second mounting bars and at least one intermediate connection member. The first and second mounting bars each have a middle portion and ends that extend upwardly and are spaced apart. The middle portion of the first and second mounting rods define a mounting plane. The at least one intermediate connection member has a first end that extends inwardly from the middle portion and is affixed to the first mounting bar and a second end that extends inwardly from the middle portion and is affixed to the second mounting bar and a middle portion that extends above the mounting plane. The elongated mounting member is affixed to the middle portion of the at least one intermediate connection member.

In accordance with yet another aspect of the present invention, there is provided a rack assembly for storing objects that includes a mounting member, a mounting bar in spaced relation with the mounting member and at least one connection member holding the mounting bar and the mounting member in spaced relation.

In accordance with another aspect of the present invention, there is provided a method of storing an elongated object having an elongated portion and a mounting portion on a device that includes a mounting member and a rack assembly affixed to the mounting member. The rack assembly includes first and second mounting bars in spaced relation and at least one connection member holding the first and second mounting bars in spaced relation. The method includes the steps of mounting the mounting member on a structure and disposing the elongated object between the first and second mounting bars. When mounted, the elongated portion is between the first and second mounting bars and the mounting portion is engaged with the first and second mounting bars.

Other objects, features and advantages of the present invention will become apparent to those skilled in the art from the following detailed description. It is to be understood, however, that the detailed description and specific examples, while indicating preferred embodiments of the present invention, are given by way of illustration and not limitation. Many changes and modifications within the scope of the present invention may be made without departing from the spirit thereof, and the invention includes all such modifications.

BRIEF DESCRIPTION OF THE DRAWINGS

The invention may be more readily understood by referring to the accompanying drawings in which.

Like numerals refer to like parts throughout the several views of the drawings.

DETAILED DESCRIPTION OF THE PREFERRED EMBODIMENTS

Figure 1:
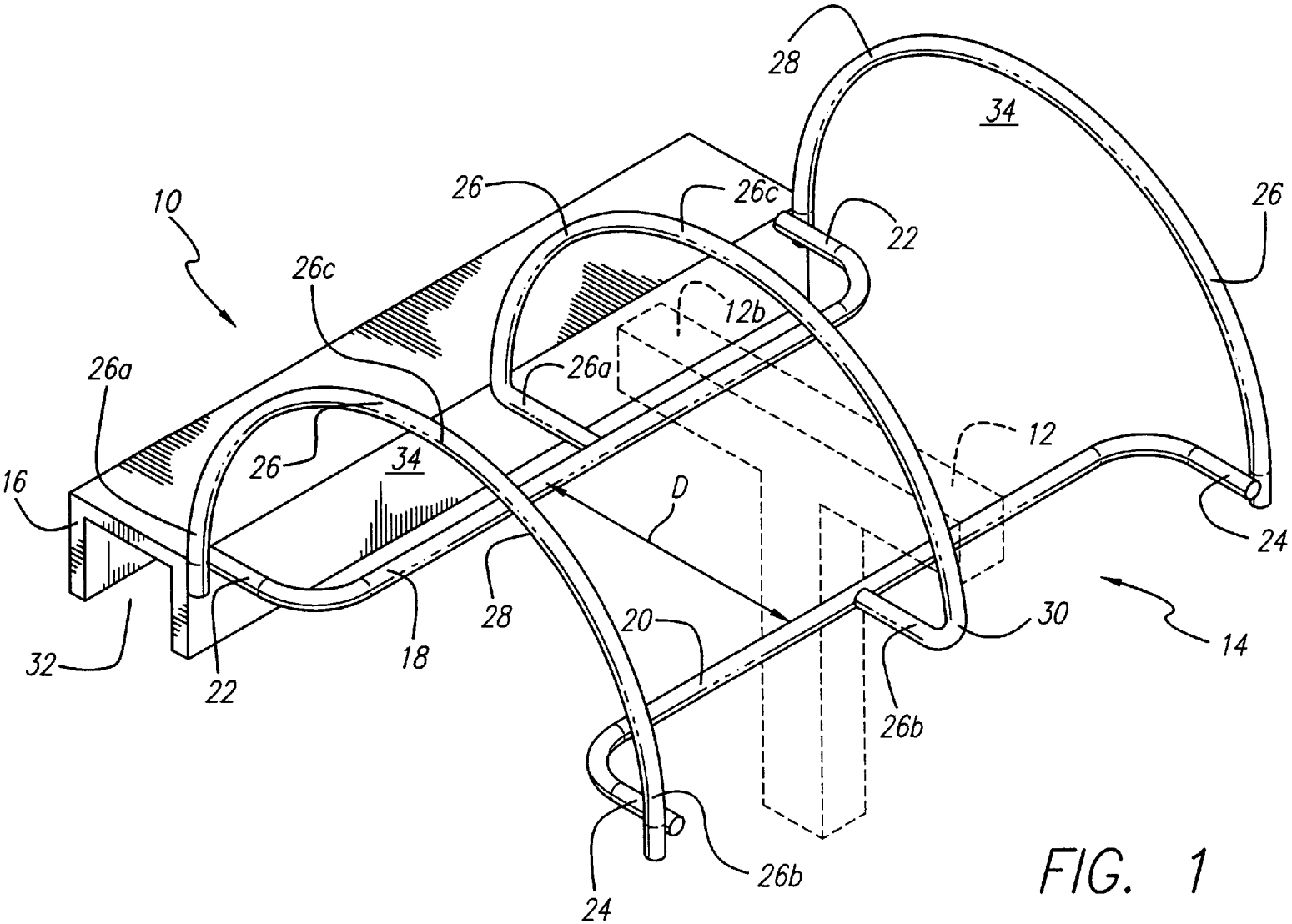
FIG. 1 is a perspective view of a device for storing elongated objects in accordance with a first preferred embodiment of the present invention, showing a stored object in phantom.
Figure 3:
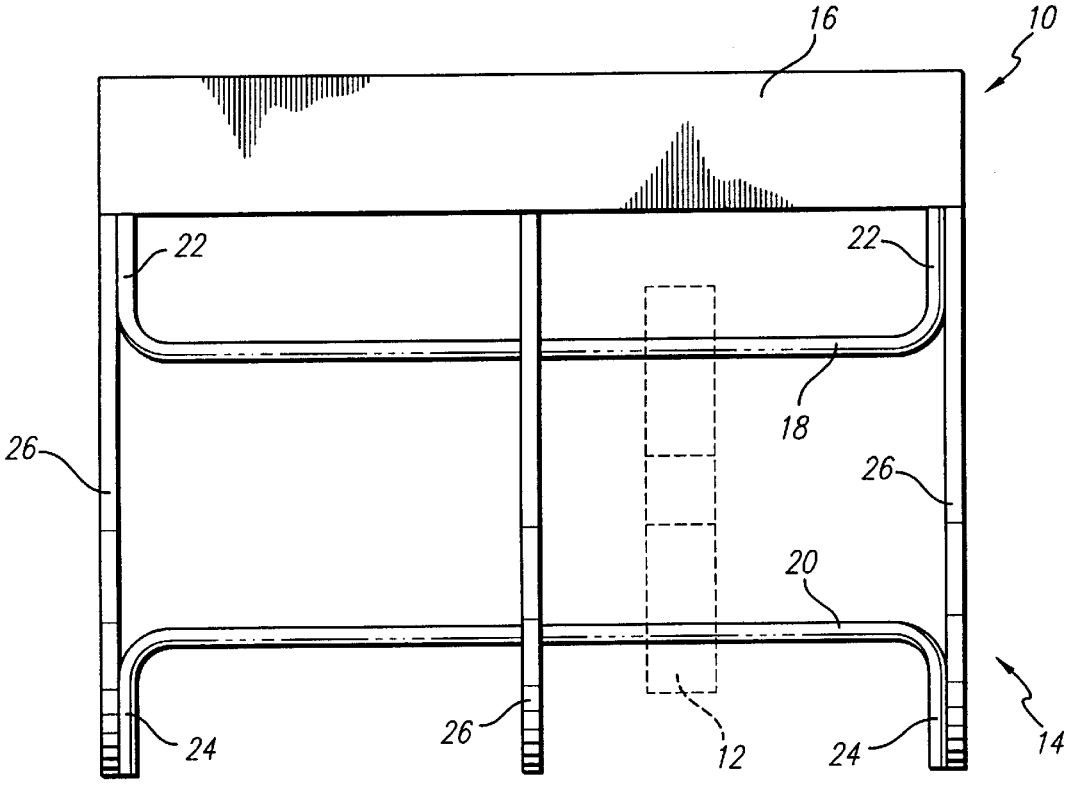
FIG. 3 is a top plan view of the device of FIG. 1 showing a stored object in phantom.
Figure 2:
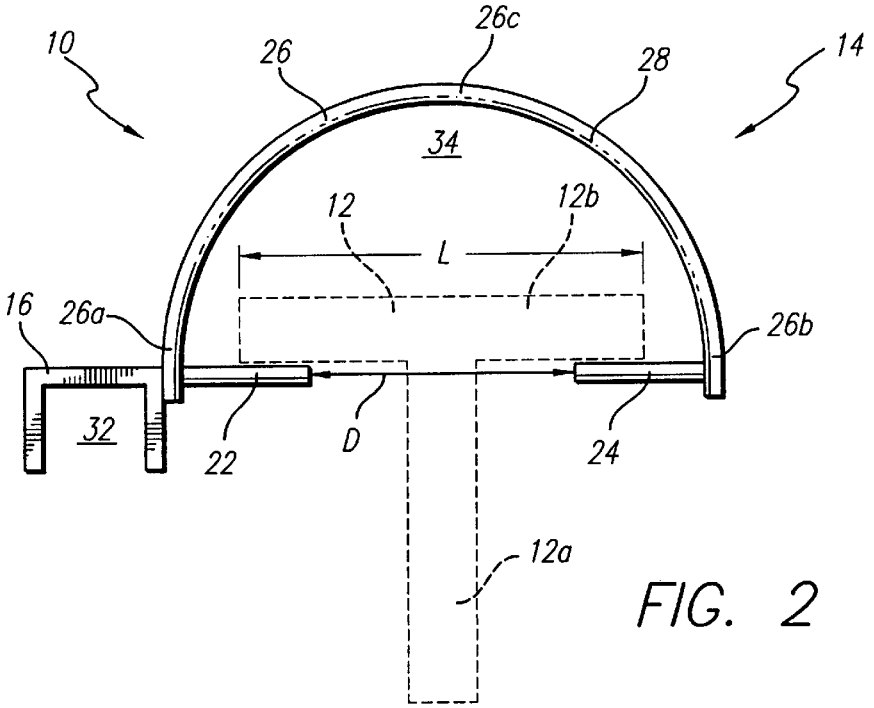
FIG. 2 is an end elevation of the device of FIG. 1 showing the rack assembly affixed to the mounting member and a stored object in phantom.

Referring to FIGS. 1–3, a first embodiment of a device 10 for storing elongated objects 12 includes a rack assembly 14 affixed to a mounting member 16. It will be appreciated that terms such as "upwardly," "outwardly," "inwardly," "above," "below" and "horizontal" used hereinbelow are merely for ease of description and refer to the orientation of the components as shown in the Figures. It should be understood that any orientation of device 10 described herein is within the scope of the present invention.

Preferably, the rack assembly 14 includes first and second elongated mounting bars 18 and 20 in substantially parallel spaced relation. The first and second elongated mounting bars 18 and 20 preferably each include ends 22 and 24, respectively, that extend outwardly away from the opposing mounting bar, as shown in FIG. 1. In the first embodiment, the ends 22 and 24 preferably extend at approximately a 90° angle. However, it will be understood that the ends 22 and 24 can extend at any desired angle, or can be curved.

Preferably, the first and second mounting bars 18 and 20 define a substantially horizontal mounting plane. Also, preferably, the ends 22 and 24 of the first and second mounting bars 18 and 20, lie in the substantially horizontal mounting plane. Alternatively, ends 22 and 24 of the mounting bars 18 and 20 can extend above or below the substantially horizontal mounting plane.

A plurality of connection members 26 hold the mounting bars 18 and 20 in spaced relation. The connection members 26 have first and second ends 26*a* and 26*b*, and a middle portion 26. The rack assembly 14 includes two end connection members 28 and at least one intermediate connection member 30. The end connection members 28 are preferably arcuate in shape. The first end 26*a* of an end connection member 26 is affixed to one of the ends 22 of the first mounting bar 18, the second end 26*b* is affixed to one of the ends 24 of the second mounting bar 20, and the middle portion 26*c* extends above the substantially horizontal mounting plane, as shown in FIGS. 1–3.

The intermediate connection member 30 preferably has an arcuate middle portion 26*c* and first and second ends 26*a* and 26*b* that extend inwardly from the middle portion 26*c* as shown in FIG. 1. Preferably, the first and second ends 26*a* and 26*b* of the intermediate connection member 30 lie in the substantially horizontal mounting plane, and the middle portion 26*c* extends above the substantially horizontal mounting plan. However, the first and second ends 26*a* and 26*b* of the intermediate connection member need not lie in the substantially horizontal mounting plane. For example, they can extend inwardly at an angle. It will be understood that the rack assembly 14 can include any number of intermediate connection members 30.

Figure 5:
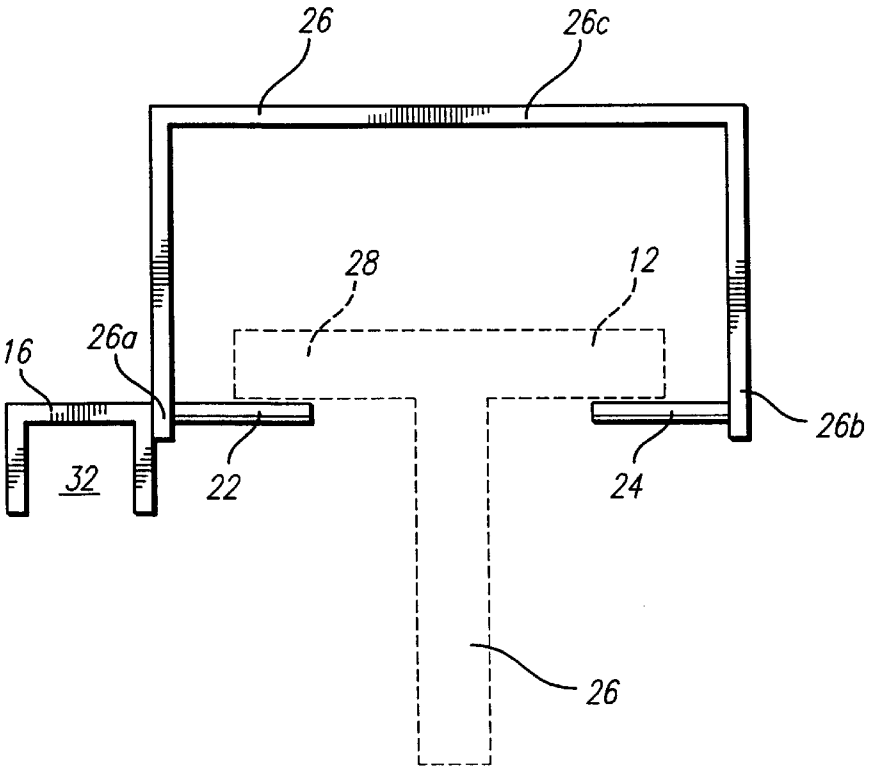
FIG. 5 is a side elevation showing an angled connection member in accordance with an alternative embodiment of the present invention.

As stated above, the portion of the connection members 26 that extends above the substantially horizontal mounting plane is preferably arcuate. However, the connection members 26 can be other advantageous shape. For example, they may comprise a plurality of straight portions including a plurality of angles, that form a unit, as shown in FIG. 5, or they may include a combination of straight and curved portions.

As illustrated, the mounting bars 18 and 20 and the connection members 26 have circular cross-sections. However, if desired, the mounting bars 18 and 20 and the connection members 26 can have square, oval or other cross-sections. It will be appreciated by those skilled in the art that the connection members 26 are dimensioned such that when an elongated object 12 is placed on the mounting bars 18 and 20, as illustrated in FIG. 1, the mounting portion 12*b* of the elongated object 12 does not come into contact with the connection members 26.

Mounting bars 18 and 20 are in substantially parallel spaced relation, thereby defining a distance D therebetween. The distance D is predetermined so that objects 12 to be stored in the device 10 fit therein, and is in no way meant to be a limitation on the present invention. The distance D is of sufficient dimension to allow the elongated portion 12*a* to fit between the mounting bars 18 and 20, and the mounting portion 12*b* to extend across distance D and engage the mounting bars 18 and 20, as best shown in FIG. 2. In other words, the length L of the mounting portion 12*b* is preferably greater than distance D.

The mounting member 16 preferably defines a mounting channel 32 which is adapted to engage an elongated member, such as a rack in a retailer's showroom. The rack assembly 14 can be connected to the mounting member in any number of ways. Preferably, the ends 22 of the first mounting bar 18 are affixed to the mounting member 16 as shown in FIG. 1. However, the connection members 26 can also be affixed to the mounting member 16. It will be understood that other means for mounting the rack assembly 14 are within the scope of the present invention. For example, clamps, hooks, fasteners, threaded fasteners, adhesives, magnets, chains, ropes and other conventional securing means can be used to secure the rack assembly 14 to a structure or the like.

Preferably, all of the components of the device 10 are comprised of a rigid metal and are welded together. However, the entire device 10 or separate components thereof can be comprised of other materials such as a rigid plastic, wood or the like. Also, the components can be affixed to one another by gluing or with threaded fasteners or other conventional attachment or connection methods. Furthermore, the entire device 10 can be formed as one unit, for example, by casting. It will be understood that the material used and the method of affixing components to one another are not intended to be limitations on the present invention.

In operation, the mounting member 16 is mounted on a structure, such as a rack or the like, and an elongated object 12 is placed into the rack assembly 14 through the entry area 34 defined below an end connection member 28. The elongated object 12 is placed onto the mounting bars 18 and 20 such that the elongated portion 12*a* is between the mounting bars 18 and 20 and the mounting portion 12*b* is in contact with the top surface of the mounting bars 18 and 20 as best seen in FIG. 2. It should be understood that the distance D is less than the length of the mounting portion 12*b* of the elongated object 12. The elongated object 12 can then be slid into a desirable position.

Figure 4:
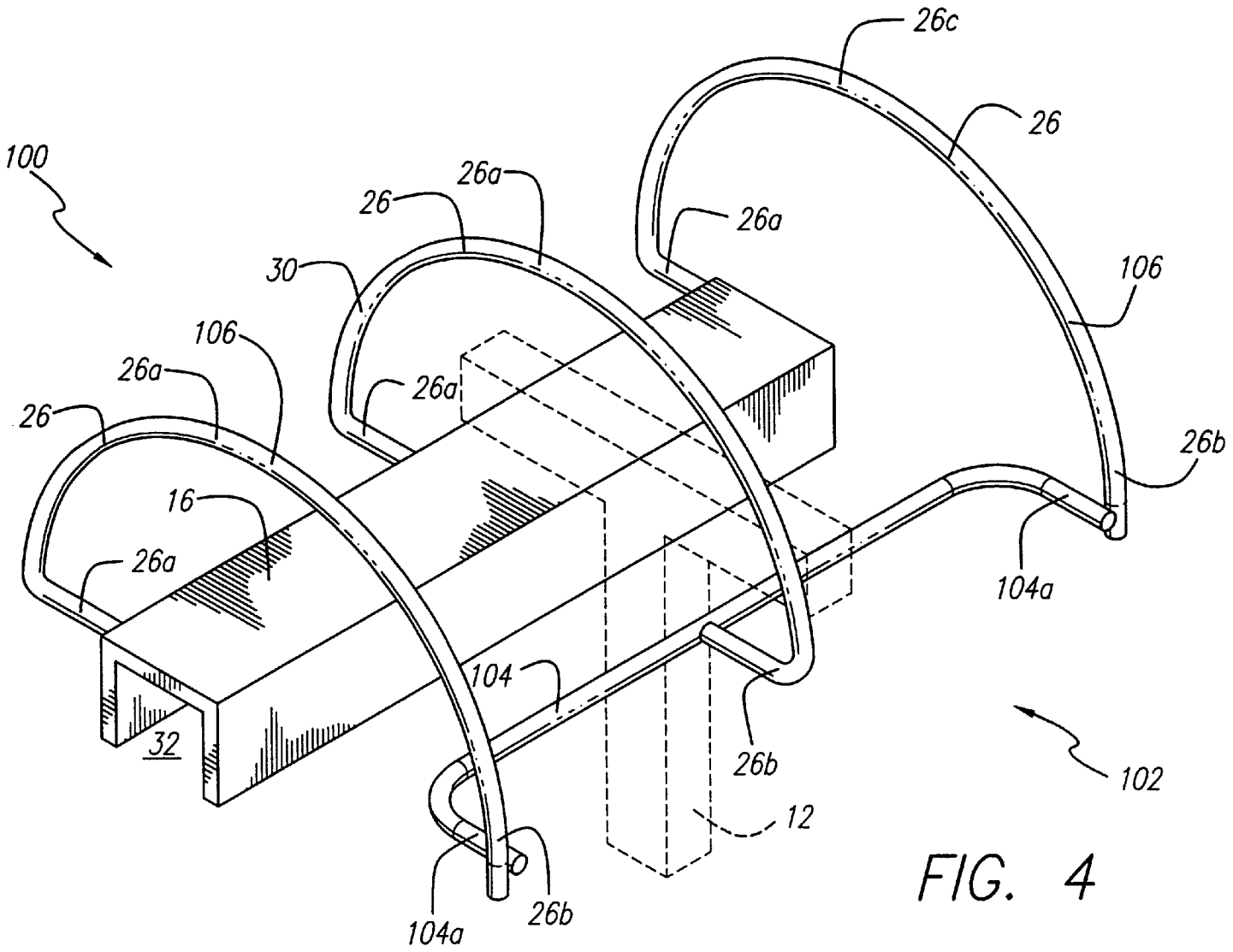
FIG. 4 is a perspective view of a device in accordance with a second embodiment of the present invention, showing the mounting member spaced from and attached to the mounting bar with a stored object in phantom.

Referring to FIG. 4, in a second preferred embodiment, the device 100 includes a rack assembly 102 with an integral mounting member 16. This embodiment is similar to the first embodiment described above with the mounting member 16 replacing the first mounting bar 18. Preferably, the mounting member 16 and the mounting bar 104 are in substantially parallel spaced relation, and define a substantially horizontal mounting plane. The mounting bar 104 has ends 104*a* that extend outwardly, as shown in FIG. 4.

The rack assembly 102 includes at least one connection member 26 that connects the mounting member 16 and the mounting bar 104 and holds them in spaced relation. The connection members 26 have first and second ends 26*a* and 26*b*, and a middle portion 26*c*, and are preferably arcuate in shape. Rack assembly 102 preferably includes two end connection members 106 and at least one intermediate connection member 30. The first end 26*a* of an end connection member 106 preferably lies in the substantially horizontal mounting plane, extends inwardly from the middle portion 26*c* and is affixed to the mounting member 16. The second end 26*b* of an end connection member 106 is affixed to one of the opposite ends 104*a* of the mounting bar 104, and the middle portion 26*c* extends above the substantially horizontal mounting plane, as shown in the FIG. 4.

The intermediate connection member 30 preferably has a curved middle portion 26*c* and first and second ends 26*a* and 26*b* that extend inwardly from the middle portion 26*c* as shown in FIG. 4. Preferably, the first and second ends 26*a* and 26*b* of the intermediate connection member 30 lie in the substantially horizontal mounting plane, and the middle portion 26*c* extends above the substantially horizontal mounting plane. It will be understood that the rack assembly 102 can include any number of intermediate connection members 30.

Figure 6:
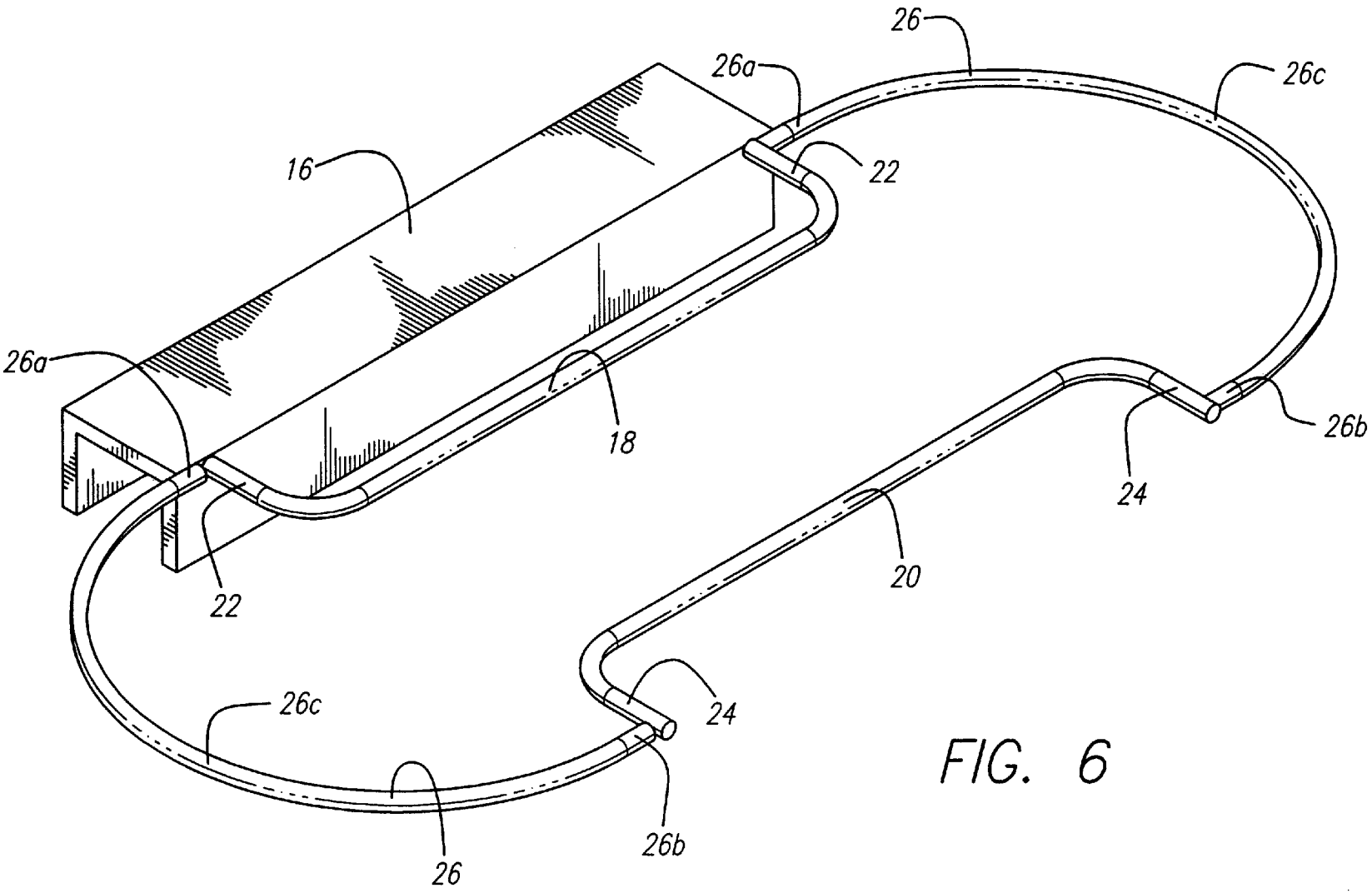
FIG. 6 is a perspective view showing the connection members lying in the same plane as the mounting bars in accordance with an alternative embodiment of the present invention.

In FIG. 6, a device 200 for storing elongated objects 12 includes connection members 26 that lie in substantially the same plane as the mounting bars 18 and 20.

Figure 8:
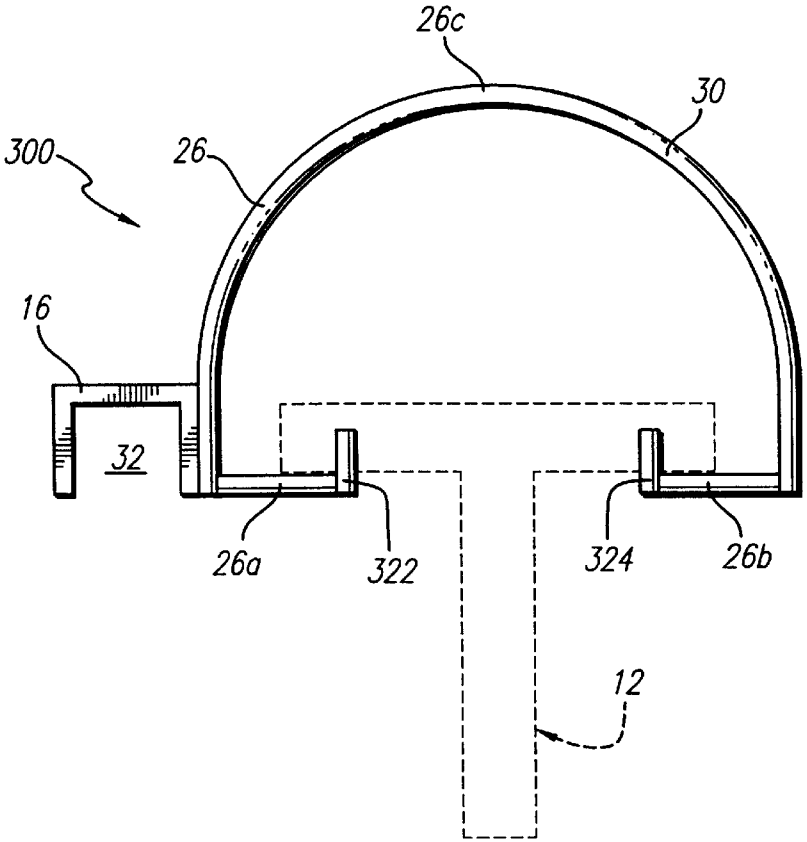
FIG. 8 is an end elevation of the device of FIG. 7 showing the rack assembly affixed to the mounting member and a stored object in phantom.
Figure 7:
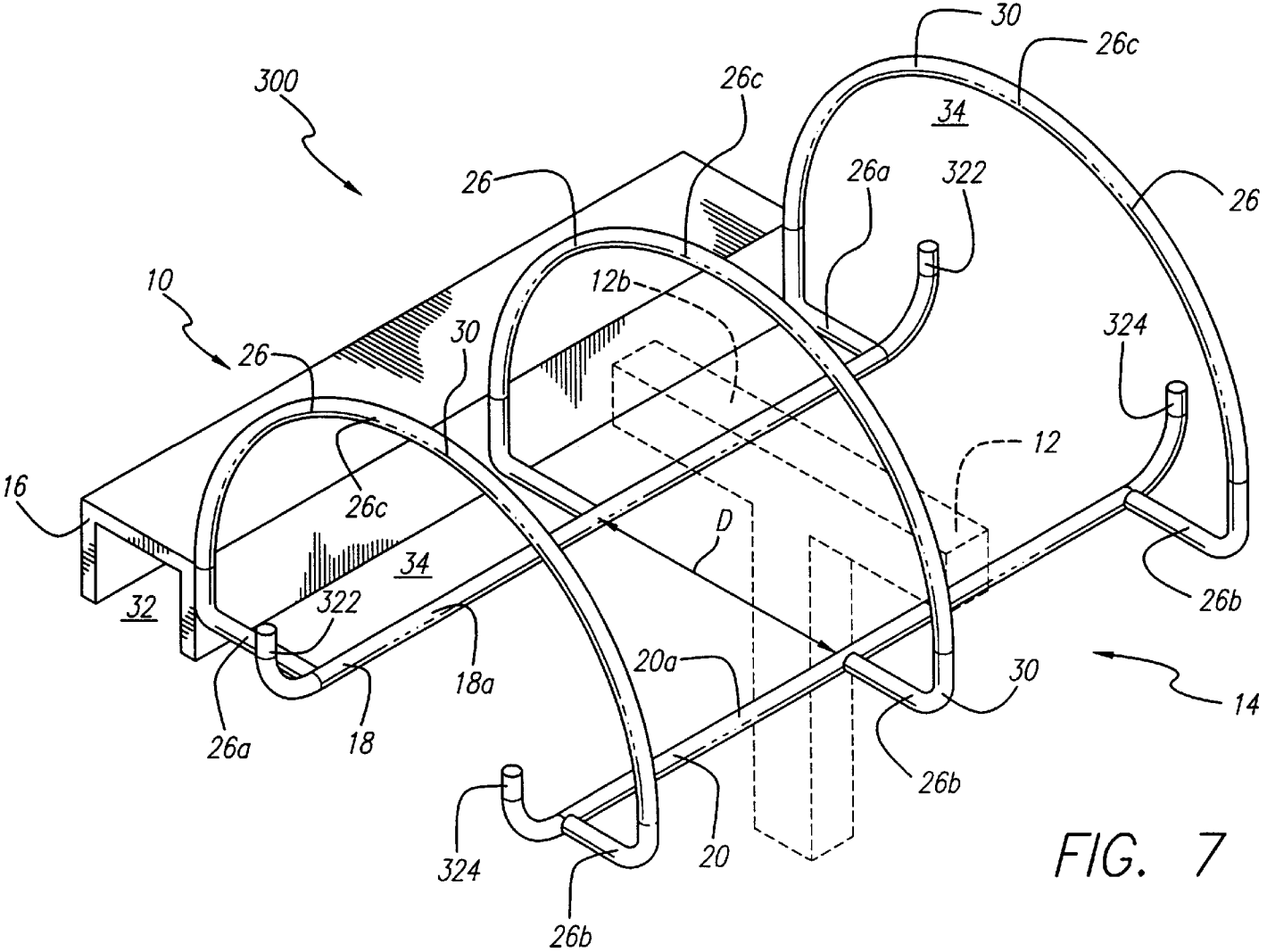
FIG. 7 is a perspective view showing a device for storing elongated objects with a plurality of intermediate connection members in accordance with a third preferred embodiment of the present invention.

In FIGS. 7–8, a third preferred embodiment of a device 300 for storing elongated objects 12 is shown. Device 300 includes mounting bars 18 and 20 with respective ends 322 and 324 that extend upwardly to prevent objects thereon from falling off. In this particular embodiment, mounting bars 18 and 20 each include a middle portion 18*a* and 20*a* that together define a horizontal mounting plane. Ends 322 and 324 extend above the mounting plane. A plurality of intermediate connection members 30 are provided for holding mounting bars 18 and 20 in spaced relation. The mounting member 16 is affixed to the middle portion 26*c* of the intermediate connection member 26. Ends 322 and 324 preferably extend upwardly at approximately a 90° angle. However, it will be understood that ends 322 and 324 can extend at any desired angle, or can be curved.

The alternative embodiments of FIGS. 5 and 6 are shown as modifications to the first embodiment described above. It will be understood that similar modifications can be made to the second and third embodiments as well.

Other alternative embodiments are also within the scope of the present invention. For example, the mounting bar(s) can have stops affixed thereto for preventing the elongated objects from falling out. The mounting bars (or mounting bar and mounting channel) can be in non-parallel spaced relation. The mounting bars or mounting member can be curved, thereby being in radially spaced relation, or angled rather than straight. The mounting member can be omitted. The rack assembly can include only one connection member. The mounting member and the mounting bar(s)can be different lengths. All such modifications are intended to be within the scope of the present invention as defined by the claims appended hereto.

What is claimed is:

1. A device for storing objects, said device comprising:

(a) a mounting member, and (b) a rack assembly affixed to said mounting member, said rack assembly comprising (i) first and second mounting bars in spaced relation, said first mounting bar being affixed to said mounting member, and (ii) at least one connection member holding said first and second mounting bars in spaced relation.

2. The device of claim 1 wherein said first and second mounting bars define a mounting plane, said at least one connection member comprises first and second ends and a middle portion, said first and second ends being affixed to said first and second mounting bars, respectively, and said middle portion extending above said mounting plane.

3. The device of claim 2 wherein said first and second mounting bars each comprise ends that extend outwardly.

4. The device of claim 2 wherein said first and second mounting bars each comprise ends that extend upwardly.

5. The device of claim 3 wherein said ends of said first and second mounting bars lie in said mounting plane.

6. The device of claim 4 wherein said ends of said first and second mounting bars lie outside said mounting plane.

7. The device of claim 1 wherein said mounting member has defined therein a mounting channel.

8. The device of claim 5 wherein said ends of said first mounting bar are affixed to said mounting member.

9. The device of claim 8 wherein said device comprises a plurality of connection members, said plurality of connection members comprising a pair of end connection members, said pair of end connection members each having a first end, a second end and a middle portion, said first end being affixed to one of said opposite ends of said first mounting bar, said second end being affixed to one of said opposite ends of said second mounting bar and said middle portion extending above said mounting plane.

10. The device of claim 8 wherein said plurality of connection members comprises at least one intermediate connection member having first and second ends and a middle portion, said middle portion extending above said mounting plane, said first end extending inwardly from said middle portion and being affixed to said first mounting bar and said second end extending inwardly from said middle portion and being affixed to said second mounting bar.

11. The device of claim 10 wherein said first and second ends of said at least one intermediate connection member lie in said mounting plane.

12. The device of claim 6 wherein said device comprises a plurality of connection members each having first and second ends and a middle portion, said middle portion extending above said mounting plane, said first end extending inwardly from said middle portion and being affixed to said first mounting bar and said second end extending inwardly from said middle portion and being affixed to said second mounting bar.

13. The device of claim 1 wherein said first and second mounting bars are in parallel spaced relation.

14. The device of claim 1 wherein said first and second mounting bars in radially spaced relation.

15. A device for storing objects, said device comprising:

(a) an elongated mounting member, (b) a rack assembly affixed to said mounting member, said rack assembly comprising (i) a first mounting bar, said first mounting bar having a middle portion and opposite ends that extend upwardly, (ii) a second mounting bar spaced from said first mounting bar, said second mounting bar having a middle portion and ends that extend upwardly, said respective middle portions of said first and second mounting rods defining a mounting plane, (iii) at least one intermediate connection member having first and second ends and a middle portion, said middle portion extending above said mounting plane, said first end extending inwardly from said middle portion and affixed to said first mounting bar and said second end extending inwardly from said middle portion and being affixed to said second mounting bar, said elongated mounting member being affixed to said middle portion of said at least one intermediate connection member.

16. A rack assembly for storing objects, said rack assembly comprising:

(a) a mounting member, (b) a mounting bar in spaced relation with said mounting member, said mounting bar including a portion that extends outwardly and is affixed to said mounting member, and (c) at least one connection member holding said mounting bar and said mounting member in spaced relation.

17. The rack assembly of claim 16 wherein said mounting bar and said mounting member define a mounting plane, and wherein said at least one connection member has a first end, a second end and a middle portion, said first end being affixed to said mounting member, said second end being affixed to said mounting bar and said middle portion extending above said mounting plane.

18. The rack assembly of claim 17 wherein said mounting bar comprises two ends that extend outwardly.

19. A rack assembly comprising:

(a) first and second mounting bars in spaced relation, said first and second mounting bars each including ends that extend upwardly, and (b) at least one connection member holding said first and second mounting bars in spaced relation.

20. The device of claim 19 wherein said first and second mounting bars define a mounting plane, and wherein said at least one connection member comprises first and second ends and a middle portion, said first and second ends being affixed to said first and second mounting bars, respectively, and said middle portion extending above said mounting plane.

21. The device of claim 20 wherein said first and second ends of said at least one connection member lie in said mounting plane.

22. A device for storing objects, said device comprising:

(a) a mounting member, and (b) a rack assembly affixed to said mounting member, said rack assembly comprising (i) first and second mounting bars in spaced relation, said first and second mounting bars each including ends that extend upwardly, and (ii) at least one connection member holding said first and second mounting bars in spaced relation.

23. A device for storing objects, said device comprising:

(a) a mounting member having a mounting channel defined therein, and (b) a rack assembly affixed to said mounting member, said rack assembly comprising (i) first and second mounting bars in spaced relation, and (ii) at least one connection member holding said first and second mounting bars in spaced relation.

* * * * *